United States Patent [19]

Prodan

[11] Patent Number: 5,029,362

[45] Date of Patent: Jul. 9, 1991

[54] FURNITURE HINGE

[75] Inventor: Marino Prodan, Koper, Yugoslavia

[73] Assignee: Lama Okovje, Dekani, Yugoslavia

[21] Appl. No.: 530,864

[22] Filed: May 31, 1990

[30] Foreign Application Priority Data

Jun. 1, 1989 [YU] Yugoslavia ..... 1131/89

[51] Int. Cl.[5] ..... E05F 1/12

[52] U.S. Cl. ..... 16/236; 16/240; 16/288; 16/294; 16/296; 16/357

[58] Field of Search ..... 16/278, 288, 291, 296, 16/304, 325, 236, 240, 246, 287, 294, 357

[56] References Cited

U.S. PATENT DOCUMENTS

| | | | |
|---|---|---|---|
| 4,050,116 | 9/1977 | Salice | 16/288 |
| 4,083,082 | 4/1978 | Holmes | 16/288 |
| 4,166,307 | 9/1979 | Rock et al. | 16/288 |
| 4,724,578 | 2/1988 | Toyama | 16/296 |
| 4,760,623 | 8/1988 | Toyama | 16/288 |

FOREIGN PATENT DOCUMENTS

| | | | |
|---|---|---|---|
| 2337224 | 2/1975 | Fed. Rep. of Germany | 16/291 |
| 2818735 | 11/1979 | Fed. Rep. of Germany | 16/288 |

*Primary Examiner*—Richard K. Seidel
*Assistant Examiner*—Edward A. Brown
*Attorney, Agent, or Firm*—Fleit, Jacobson, Cohn, Price, Holman & Stern

[57] ABSTRACT

A furniture hinge has a first hinge arm and a second hinge arm which are interconnected by inner and outer pivot levers. The inner pivot lever carries a control cam within the first hinge arm for cooperating with an internal coil spring so that the hinge can snap between open and closed positions. A transverse pin within the first hinge arm transmits force between the spring and the control cam. The pin is carried in elongate slots which are inclined with respect to the longitudinal axis of the coil spring. In the closed position of the hinge, the pin engages a snapping section of the control cam and in the open position of the hinge the pin engages a radiused sliding section of the cam.

3 Claims, 1 Drawing Sheet

FURNITURE HINGE

BACKGROUND OF THE INVENTION

The invention belongs to the field of construction engineering, particularly building constructions, and concerns fittings for doors, more precisely devices for moving the door wing into open/closed position by means of spring force, the door wings being of the pivoting kind.

The invention is based on the problem of how to re-arrange and interconnect the components of a cup-hinge in order to obtain such a short assembly, which could be used even in the least convenient hinge situation, i.e., the situation when the door wing partly overlaps the side wall of the furniture or the door wing is incorporated into the frame of the wardrobe.

From DE 28 18 735 A1 there is known a hinge having a spring catch mechanism comprising a hinge arm, which, by means of two screws, is fastened through its base plate to the furniture side wall and is, by means of two hinge pivot levers, connected to a hinge cup. The latter is inserted into a corresponding blind hole of the furniture door wing and fastened thereto by means of screws.

In the section of the hinge arm facing the hinge pivot levers there is arranged along the arm the housing of a spring, which housing is by a dowel belonging to the inner hinge pivot lever inside the hinge arm connected to the hinge arm. In the housing there is arranged longitudinally in the direction of the hinge arm a helical spring accomodating a thrust bolt, which contacts a section of the inner hinge pivot lever in the hinge arm, which section is provided with a cam. On its front end the thrust bolt comprises a bevel facing the hinge pivot lever and the base plate.

In the direction towards the hinge cup the housing of the spring is provided with a prolongation having a longitudinal groove, which serves as a guidance for the lateral faces of the inner hinge pivot lever.

Due to the arrangement of the spring along the hinge arm the above constructional solution really makes possible the incorporation of helical springs of any length, but to cooperate with them a big pushing cam of the inner hinge pivot lever in the hinge arm is necessary, which results in a big stroke of the spring, thereby weakening the effect of the increased length of the spring. Long hinge arms are necessary, which influences the price of the article. The manufacture of hinge arms is more complicated when the door wing is incorporated into the frame of the wardrobe or the door wing partly overlaps the side wall of the furniture because in such cases relatively high and bent hinge arms are needed.

A further disadvantage of the known solution resides in the fact that due to the small supporting area between the prolongation of the housing of the spring and the cam of the inner hinge pivot lever there are generated high surface pressures, which results in a rapid wear of the elements with lower hardness.

SUMMARY OF THE INVENTION

In a hinge arm there is arranged a spring assembly, which comprises a housing, on whose base part there is located a positioning projection for the spring and on whose lateral walls two slanting slots are foreseen for receiving a pin, which is supported by the curved surface of a plastic control cam. In its cross-section the latter is cap-shaped and is form-lockingly connected to a correspondingly shaped receiving part of an inner hinge lever.

When opening the furniture door, the inner hinge lever and thereby the plastic control cam are swung around a hinge dowel connecting the inner hinge lever and the hinge arm. Thereby the snapping section of the plastic control cam pushes the pin guided in the side slanting slots of the spring housing, which results in the compression of the spring. At opening the door wing further, the snapping section of the plastic control cam is followed by a sliding section, which is defined by a circle, whose centre resides in the hinge dowel of the inner hinge lever. Thus, at the further opening of the door wing the pin slides along the sliding section of the plastic control cam, which make possible a soft and even opening of the door up to the end position when the door is fully open.

When closing the furniture door, the hinge lever and thereby the plastic control cam evenly move in the opposite direction until the sliding pin moving along the sliding section of the plastic control cam reaches the snapping section thereof. The pin inserted in the slanting slots of the housing, aided by the spring force burdening it, begins to push away the plastic control cam and thereby also the inner hinge lever. The moment of rotation generated thereby makes it possible that the door is kept in its closed position.

BRIEF DESCRIPTION OF DRAWINGS

Below, the invention is described in more detail with reference to an example of embodiment shown in the accompanying drawings wherein.

DESCRIPTION OF PREFERRED EMBODIMENTS

Figure 1:
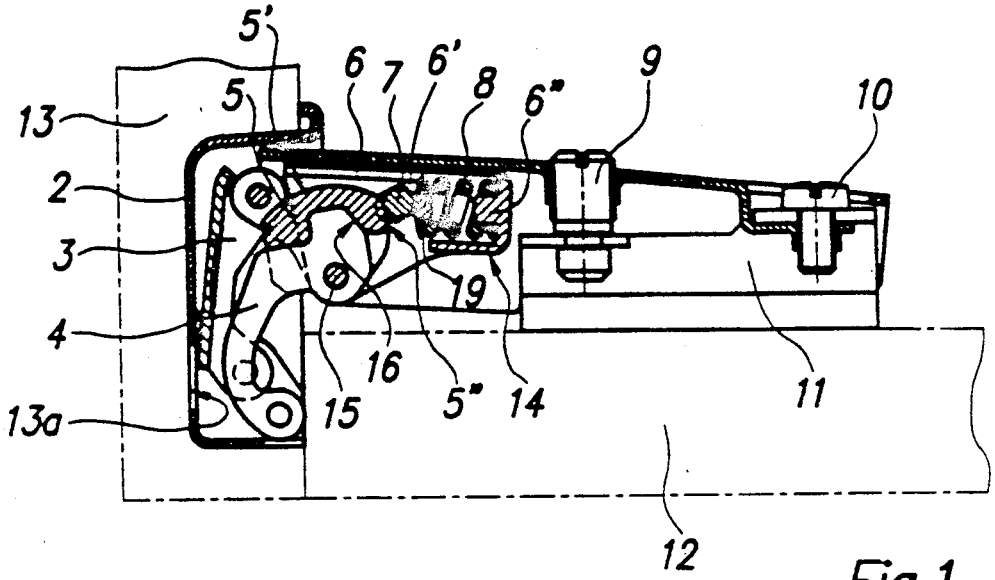
FIG. 1 is a cross-sectional elevation of the furniture hinge when snapped (the door is closed)
Figure 2:
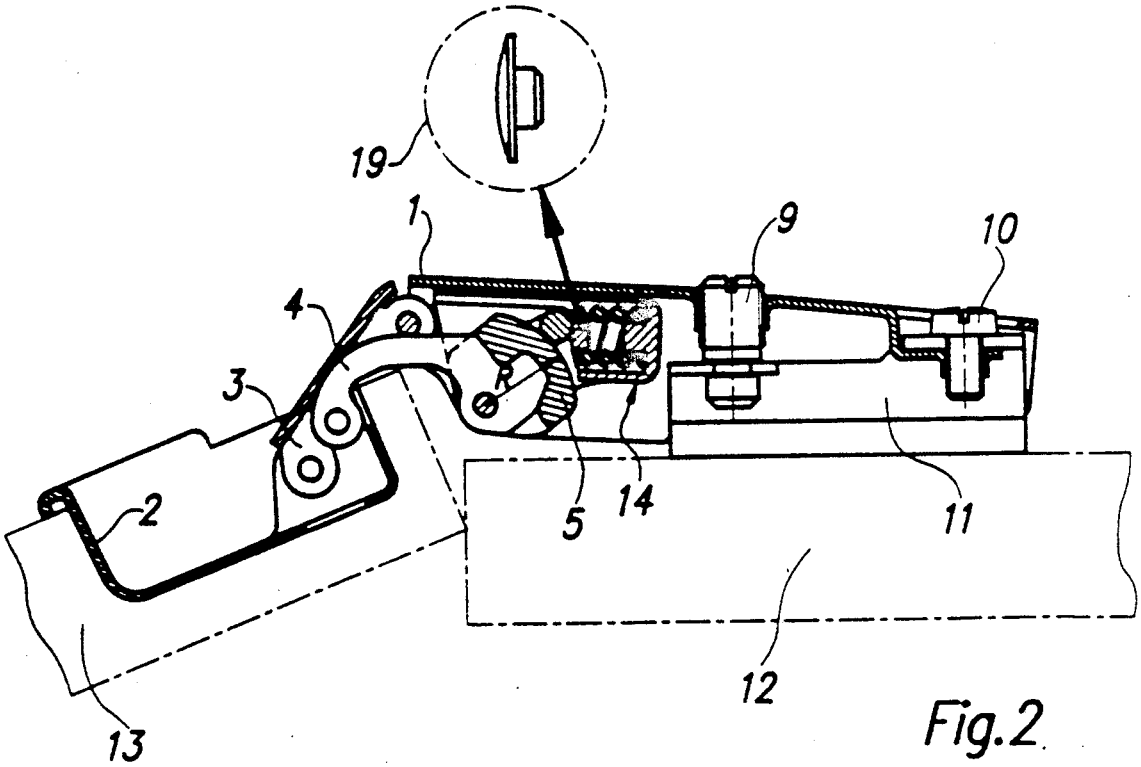
FIG. 2 is the same as FIG. 1, yet at the open door.

The furniture hinge is composed of a hinge arm 1, which is by means of an outer pivot lever 3 and of an inner pivot lever 4 connected to a hinge cup 2. The latter is inserted into a shallow blind hole 13*a* of a door wing 13 of a furniture box. On a side wall 12 of the furniture box the base plate 11 of the furniture hinge is fastened, onto which the stationary hinge arm 1 is attached by means of a fixing screw 10 and an adjusting screw 9.

The snapping function of the furniture hinge resides in the interaction of a spring assembly 14 and a plastic control cam 5. The spring assembly 14 is inserted into the hinge arm 1, whose cross-section is box-shaped, similar to the letter U. The spring assembly 14 is connected to the hinge arm 1 by a dowel 15, which connects the inner pivot lever 4 and the hinge arm 1. The dowel 15 is inserted through the side walls of a housing 6 of a spring 8. The plastic control cam 5 is integrally bound to the inner pivot lever 4 in the area of the dowel 15 of the lever 4.

The spring assembly 14 consists inter alia of the housing 6 of the spring 8, the cross-section of the rear part of the housing, which is oriented towards the hinge arm 1, being box-shaped. The cross-section of the front part of the housing 6 is box-shaped as well, similar to the letter U, and in the side walls of the front part of the housing 6 bearings for the dowel 15 are foreseen. The rear part of the housing 6 is closed and provided with a locating projection 6", which serves to position the longitudinally arranged spring 8. The side walls of the housing 6 are provided with slanting slots 6', into which there is inserted a pin 7 supporting the spring 8. At the rotary movement of the wing 13, the pin 7 moves along the slanting slots 6', thereby activating the spring 8.

For holding the door wing 13 in closed position, a relatively high closing moment of rotation is obtained by a relatively great radius R of the sliding section 5' of the control cam 5. In order to provide a short deformation of the spring 8 in spite of the fact that the radius R is relatively great, into the assembly 14 a gearing is incorporated, which is formed by the transmission pin 7 and the slanting slots 6' of the housing 6 in cooperation with the cam 5. It is a result thereof that the compression stroke of the spring 8 is limited to the normal projection of the movement path of the pin 7 in the slanting slots 6' onto the axis of symmetry of the longitudinally positioned spring 8. To avoid a direct contact of the pin 7 and the spring 8, the free end of the latter is provided with a disc-shaped insertion 19, which makes the spring 8 constantly act horizontally, regardless of the position of the pin 7 in the slanting slots 6'.

In the cross section the plastic control cam 5 is cap-shaped. The inner contour 16 thereof corresponds to the surface of the inner pivot lever 4. The size of the control cam 5 is determined by the radius R of the sliding section 5', whose center is the dowel 15. The snapping section 5" of the cam 5 serves for generating the closing moment of rotation and thereby for retaining the wing 13 of the furniture door in the closed position.

The inner pivot lever 4 provided with the plastic control cam 5 is inserted between the side walls of the housing 6 of the spring 8 and is connected therewith by means of the dowel 15. In the closed position the pin 7 supports the snapping section 5" of the cam 5. The pin 7 is burdened by the force of the spring 8 that is transmitted via the pin 7 to the cam 5. Thereby a movement of rotation is created, which holds the door wing 13 in the closed position.

When opening the door the pivot lever 4 is shifted around the dowel 15. This shifting also means the shifting of the cam 5, which by its snapping section 5" pushes the pin 7 along the slanting slots 6' and thereby compresses the spring 8. At a defined angle of the opening of the door the snapping section 5" of the cam 5 changes into the sliding section 5'. From this moment on and until the door is fully open, the sliding section 5' of the cam 5 slides on the pin 7, which makes possible a soft and even opening of the door.

Also at closing the door 13, the cam 5 by its sliding section 5' slides on the pin 7. At a defined angle piror to closing, the sliding section 5' of the cam 5 changes into the snapping section 5". At that moment the pin 7, by means of the spring 8, begins to push away the cam 5 and thereby the door wing 13 until it snaps in the closed position.

What is claimed is:

1. A furniture hinge comprising a first hinge arm and a second hinge arm, inner and outer pivot levers connected between the hinge arms, a coil spring within the first hinge arm, the coil spring having an axis extending lengthwise of the first hinge arm, a control cam on the inner pivot lever within the first hinge arm, a transverse pin within the first hinge arm trapped between the control cam and the spring for transmitting forces between the control cam and the spring, and elongate slot formations formed in the first hinge arm for carrying said pin, the slot formations being inclined with respect to said axis, the pin being movable along the slot formations between an open position of the hinge wherein the pin is urged toward one end of the slot formations by the control cam thereby compressing the spring and a closed position of the hinge wherein the pin is urged toward an opposite end of the slot formations by rotation of the control cam and extension of the spring.

2. A hinge as claimed in claim 1, wherein the control cam has a radiused sliding section engaging the pin in the open position and a snapping section engaging the pin in the closed position and retaining the hinge in the closed position under force of the spring.

3. A hinge as claimed in claim 2, wherein the first hinge arm has an adjustment screw for adjustably securing same to a base plate and wherein the spring is located wholly between the screw and the control cam.

* * * * *